United States Patent [19]

Martens

[11] Patent Number: 4,755,148

[45] Date of Patent: Jul. 5, 1988

[54] CONVERTIBLE CONNECTOR

[75] Inventor: John D. Martens, Corinth, Tex.

[73] Assignee: Elfab Corporation, Lewisville, Tex.

[21] Appl. No.: 53,520

[22] Filed: May 15, 1987

Related U.S. Application Data

[63] Continuation of Ser. No. 766,321, Aug. 16, 1985, abandoned.

[51] Int. Cl.[4] ..... H01R 29/00

[52] U.S. Cl. ..... 439/166

[58] Field of Search ..... 439/126, 166, 170–174, 439/176, 177, 518, 607, 608

[56] References Cited

U.S. PATENT DOCUMENTS

| | | | |
|---|---|---|---|
| 3,170,752 | 2/1965 | Van Horssen | 339/74 R |
| 4,206,964 | 6/1980 | Olsson | 339/221 M |
| 4,239,320 | 12/1980 | Hesse et al. | 339/154 A |
| 4,371,226 | 2/1983 | Brancaleone | 339/143 R |
| 4,398,780 | 8/1983 | Novotny | 339/49 R |
| 4,512,618 | 4/1985 | Kumar | 339/143 R |

FOREIGN PATENT DOCUMENTS

| | | | |
|---|---|---|---|
| 0070392 | 1/1983 | European Pat. Off. | 339/31 R |

*Primary Examiner*—Joseph H. McGlynn

*Attorney, Agent, or Firm*—Weingarten, Schurgin, Gagnebin & Hayes

[57] ABSTRACT

A convertible connector which may be either a male or female pressfit connector uses a common metal shell that is reversed depending upon whether a male or female connector is used, and which receives one of two different insulators depending upon the type of connector to be made. The insulator is used to press fit the terminal pin into the printed circuit board, and a standard prior art male pressfit terminal pin is used with a metallic tube fitted over one end of the male pressfit terminal to adapt it for use in the convertible connector.

6 Claims, 6 Drawing Sheets

CONVERTIBLE CONNECTOR

This application is a continuation of application Ser. No. 766,321, filed Aug. 16, 1985, now abandoned.

FIELD OF THE INVENTION

The invention relates to connectors and more particularly to a connector that is convertible between a male and female connector that is press fitted on to a printed circuit board.

PRIOR ART

Generally, most connectors are either male or female, and the connector housing and terminal pins are made for that connector. As such the terminals are not suitable for other connectors and no part of one type connector is usable with the other type. Most pressfit terminals are made from a flat stock and to make a tubular end the end has to be rolled. Press fit connectors are illustrated in U.S. Pat. No. 4,269,468. In this patent the connector housing is used to press fit the terminal into the circuit board.

SUMMARY OF THE INVENTION

The present invention is directed to a convertible connector that may be either male or female and uses existing pressfit terminals. A metal shell houses an insulator material in which the terminal contacts are mounted. Depending upon which type the connector is to be, male or female, a different insulator is used, but the same metal shell is used for both.

Two different insulators are illustrated to accommodate either a female terminal contact or male contact. If a male contact is to be used, a pressfit terminal is used with a flanged tubular member fitted over one end. With either terminal, the insulator is used to pressfit the terminal in place. The insulator for the male connector is also used to hold the tubular member in place.

The advantages and technical advance represented by the invention will become apparent to those skilled in the art from the following detailed description taken with reference to the accompanying drawings.

Figure 1:
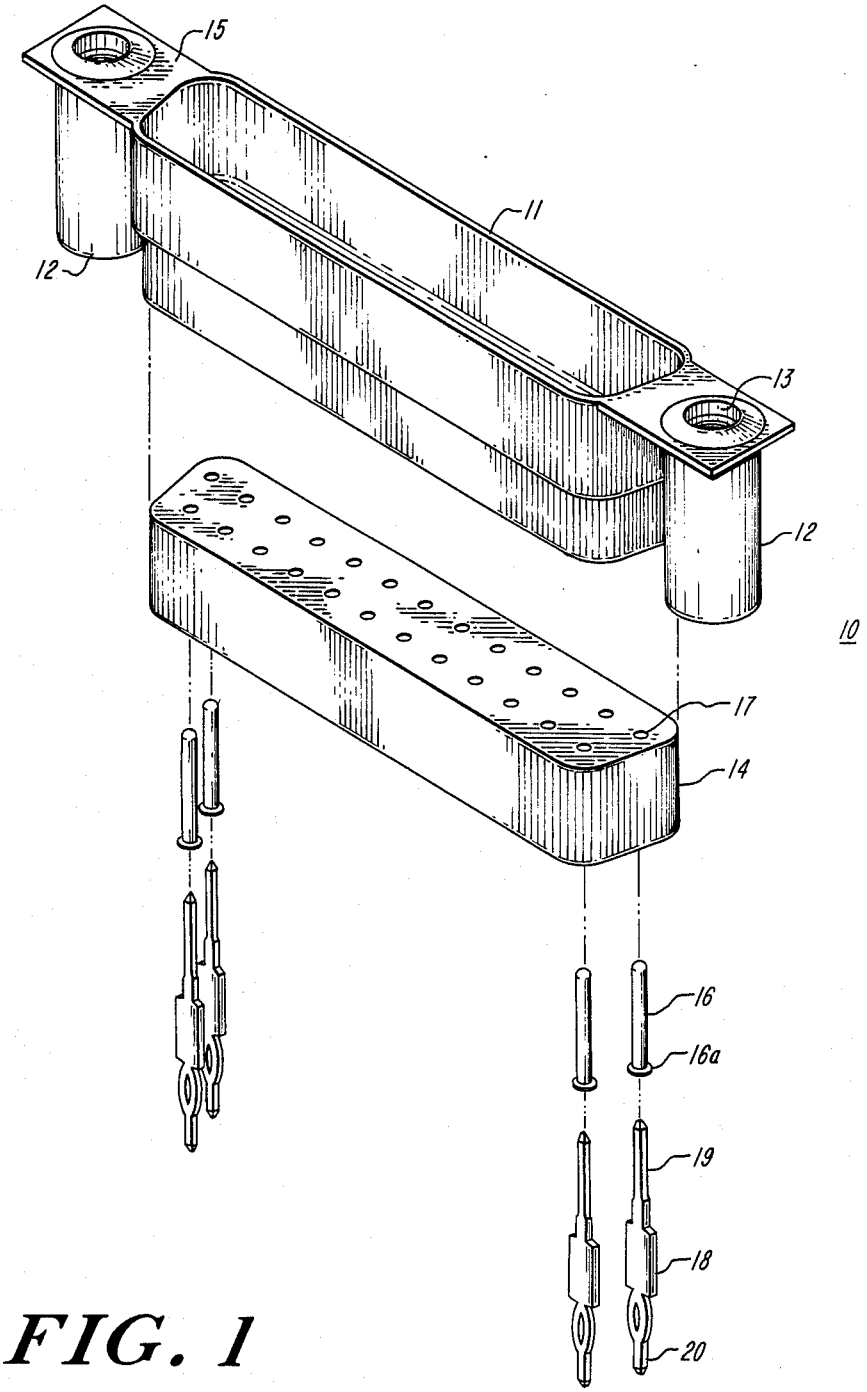
FIG. 1 is an exploded view of a male connector of the present invention.
Figure 2A:
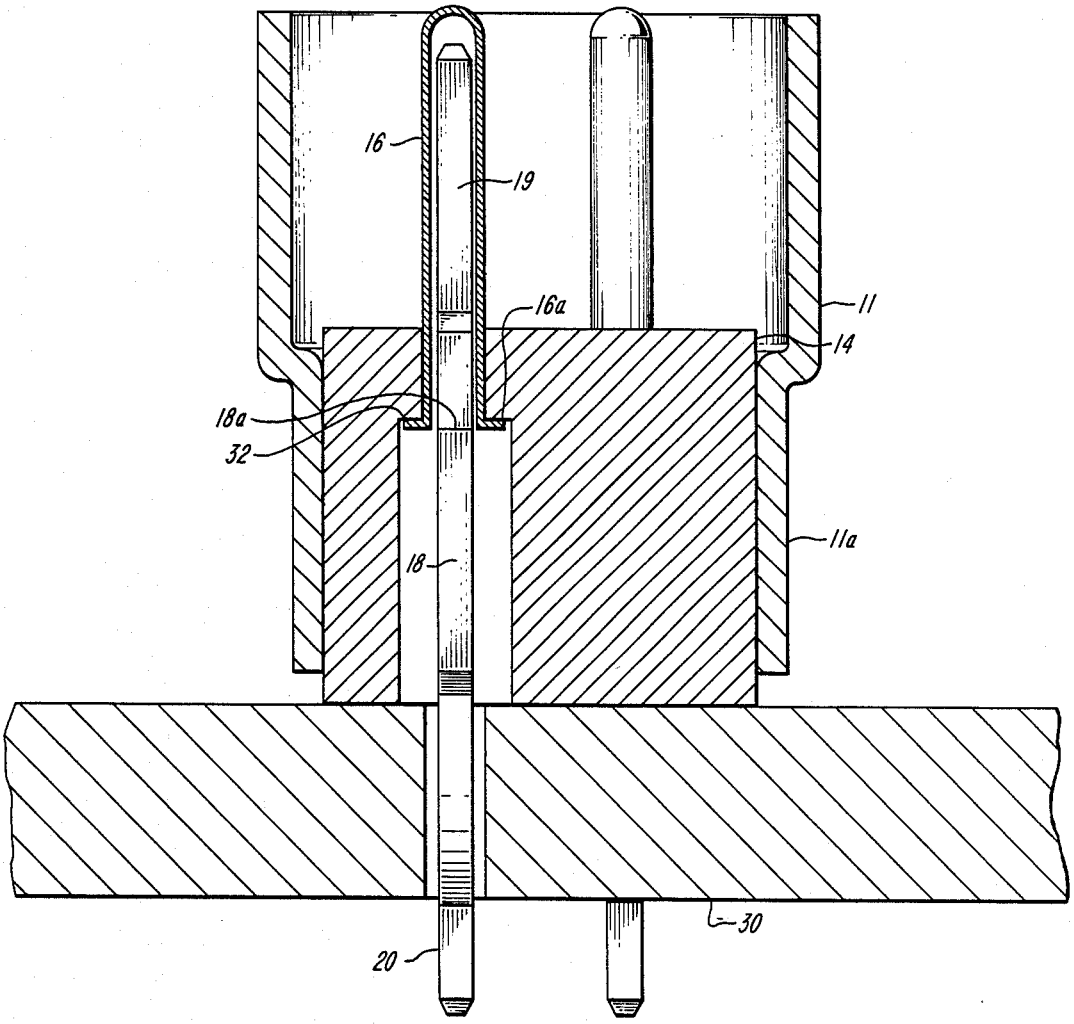
Figure 2B:
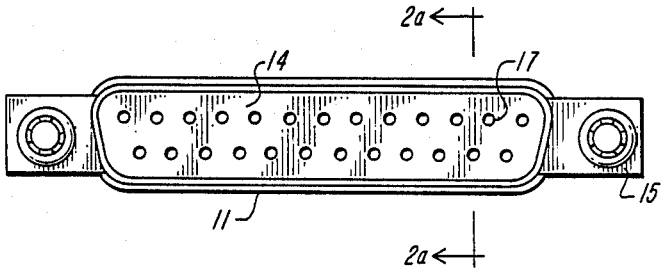
Figure 2C:
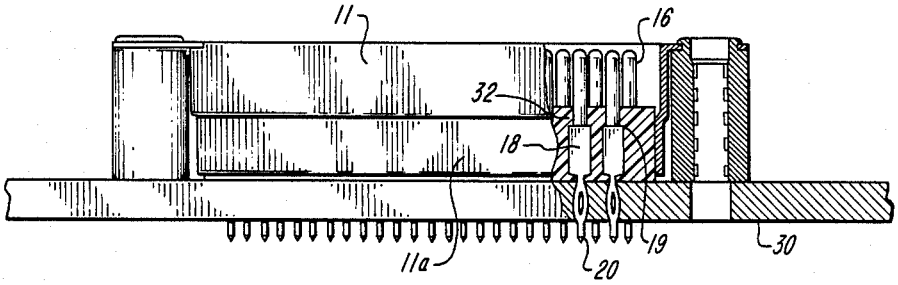
Figure 2D:
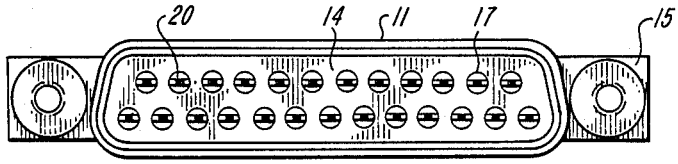

FIGS. *2a,2b,2c* and *2d* are end, top, side and bottom views of the connector of FIG. 1 with FIG. *2a* illustrating the section *2a—2a* of FIG. *2b;*

Figure 3:
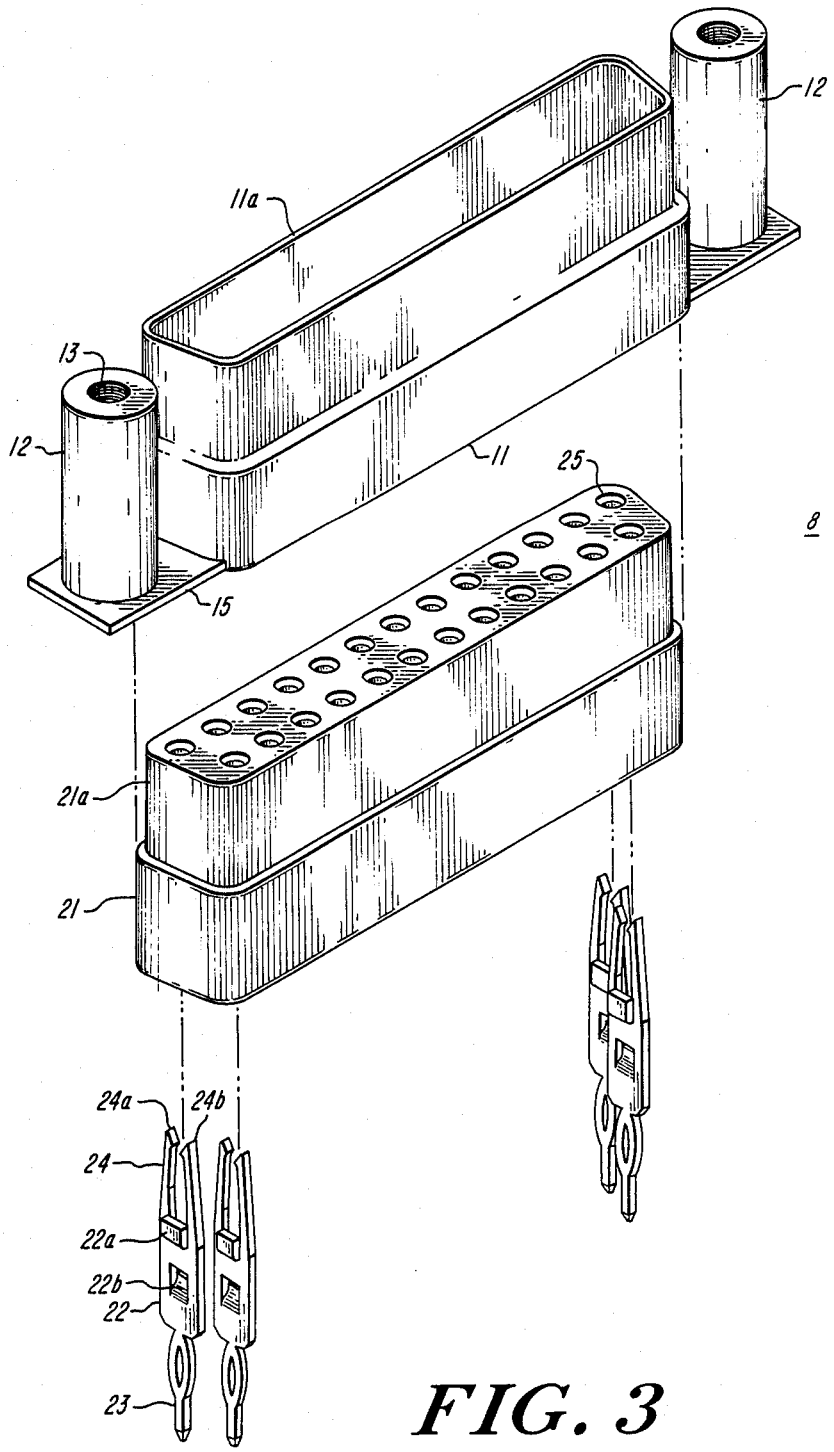
Figure 4A:
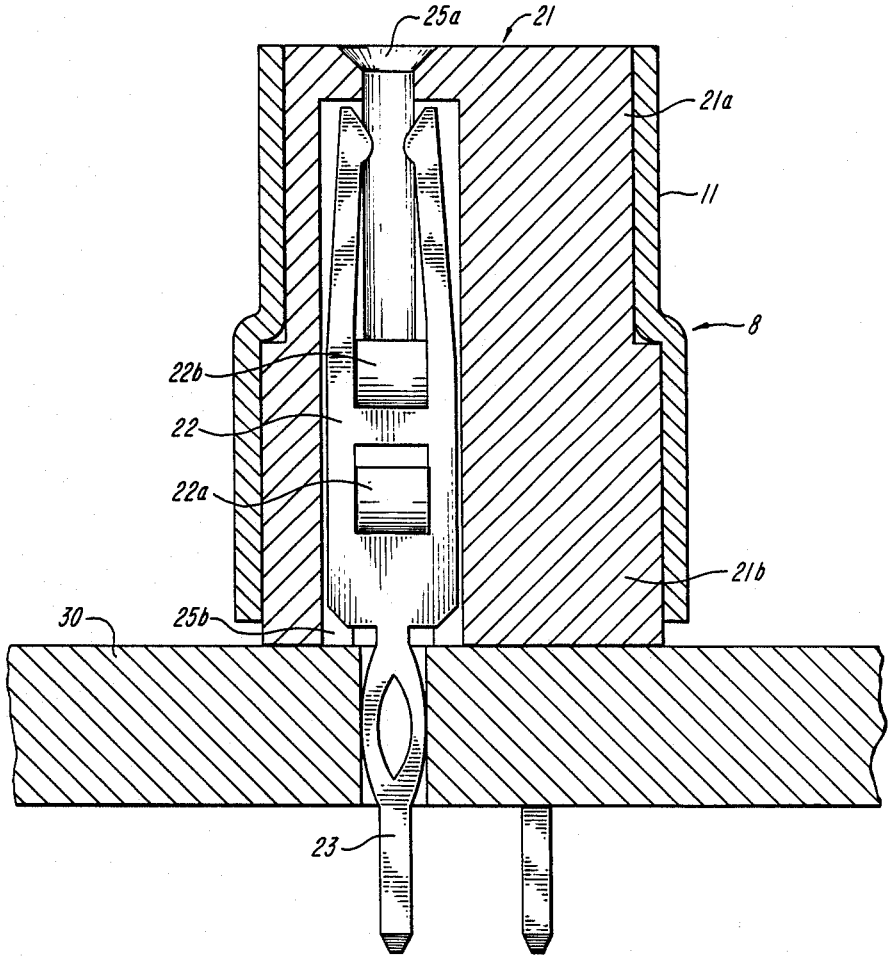
Figure 4B:
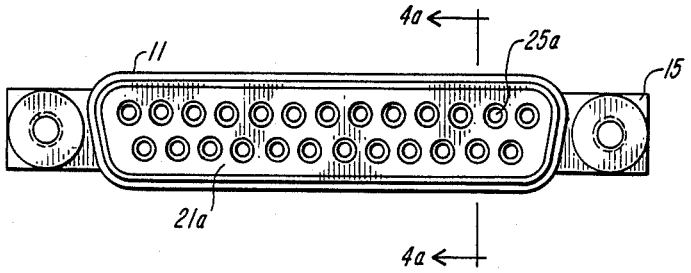
Figure 4C:
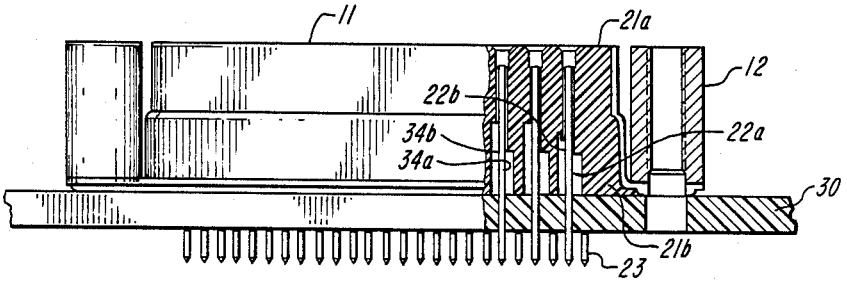
Figure 4D:
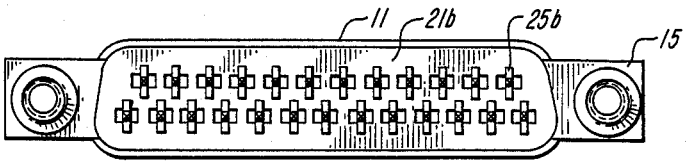

FIG. 3 is an exploded view of a female connector of the present invention; and FIGS. *4a,4b,4c* and *4d* are end, top, side and bottom views of the connector of FIG. 3 with FIG. *4a* illustrating the section *4a—4a* of FIG. *4b.*

DESCRIPTION OF THE PREFERRED EMBODIMENTS

FIG. 1 is an exploded view of a male connector of the present invention. The connector 10 includes a metal shell 11, an insulator 14, terminal contacts 18, and tubular members 16.

Metal shell 11 is in the form of a thin metal shell that is approximate D-shaped in cross section along its length. There are two different D-shaped cross sectional areas, one smaller than the other. Each of the cross sections areas accommodate a different insulating housing. One is used for a female connector and the other is used for a male connector. Metal shell 11 is configured to receive the insulator 14. Metal shell 11 has tabs 15 on each end perpendicular to the walls of the metal shell.

Each tab 15 has a mounting stud 12 which is braded to the tab 15, the stud being threaded to receive fastening screws from a mating connector, and to secure the metal shell to a circuit board.

Insulator 14 mounts in the shell 11 and the terminals reside in holes 17 in insulator 14. Holes 17 extend completely through the insulator. A tubular member 16 is placed over an end 19 of each terminal 18.

FIGS. *2a, 2b, 2c,* and *2d* are end, top, side and bottom views of the connector for FIG. 1. FIG. *2a,* is a cross sectional view taken through section *2a—2a* of FIG. *2b* and illustrates a connector assembled and mounted on a printed circuit board and clearly shows the relationship of the parts. The metallic shell 11 has the insulator enclosed in the lower, narrower part 11*a.* Each terminal 18 has the tubular member 16 placed over end 19 which is inserted into each of the openings 17 of insulator 14. After all of the terminals have been inserted into the insulator 14, the insulator-terminal assembly is press fitted into circuit board 30, the compliant pressfit ends 20 of the terminals 18 being pressed into corresponding holes in the printed circuit board. The actual pressing of the terminals is by shoulder 32 (FIG. *2a*) of insulator 14 onto shoulder 18*a* of terminal 18, and the lip 16*a* of tubular member 16. After the terminals have been press fitted into the circuit board, the metallic shell 11 is placed over the insulator and secured to the printed circuit board.

The details of the assembled and mounted connector are further illustrated in FIGS. *2b, 2c,* and *2d.* All parts of the connector have the same identification numbers in each of the detailed drawings.

FIG. 3 illustrates an exploded view of a female connector 8 of the present invention. The same metal shell 11 is used, however, a different insulator 21 is used. The insulator has portion 21a that is slightly smaller than the other part 21*b.* The contacts are pressfit terminals comprised of a central portion 22, pressfit tabs 22*a* and 22*b,* a compliant pressfit end 23, and an end 24 that is comprised of two opposed contact ends 24*a* and 24*b.* The ends 24*a* and 24*b* are configured, for example to received the tubular member 16 of the male connector.

FIGS. *4b,4c* and *4d* are top, side and bottoms views of the female connector. FIG. *4a* is a cross sectional view taken through section *4a—4a* of FIG. *4b* wherein the female connector 8 is illustrated mounted on a circuit board 30. Terminals 22 are press fitted into the circuit board so that end 23 of terminal 22 extends through the circuit board. Terminal 22 has two pressfit tabs 22*a* and 22*b* that extended out from the terminal in such a way that there is a surface of each of the tabs 22*a* and 22*b* that engages a notch in the insulator 21. These notches 34*a* and 34*b* (FIG. *4c*) are used to pressfit terminal 22 into the circuit board 30. The press fitting is accomplished by inserting ends 23 of terminals 22 into the openings in the circuit board 30, the terminals 22 having already been placed in the insulator 21, and applying a pressure to insulator 21 of sufficient magnitude to pressfit all the terminals 22 into the circuit board. After the terminals are press fitted into the circuit board, the metal shell ll is placed over the insulator and secured to the circuit board using screws (not illustrated) that are screwed into the mounting posts 12.

The procedure for assembling both the male and female connectors is the same. The terminals, extending out one side of the insulator, are placed in the circuit board and then press fitted into place with the insulator. The metal shell is then placed over the insulator and is secured to the circuit board. The metal shell is the same for each connector embodiment, but is inverted for one connector in comparison with the other connector. Ordinary pressfit terminals are used. However, in the case of the male connector, a tubular member is placed over the end of the terminal to provide an end that will mate with a corresponding female connector. By providing different length insulators and different size metal shells, a connector with a desired number of terminals may be mounted on circuits boards to meet the interconnection requirements for each circuit. Since the connectors are assembled on the board, it is necessary only to have a supply of terminals, insulators and metal shells to be able to assembly the connector of a required size.

The present invention may be modified and changed without departing from the spirit and scope of the invention, and the illustrated embodiments should not be considered restrictive of the scope of the invention.

What is claimed:

1. A convertible connector for mounting on a printed circuit board, comprising:

a plurality of terminal contacts configured for press fitting into the printed circuit board;

insulator means configured for receiving therein said plurality of terminal contacts and for pressfitting said plurality of terminal contacts into the printed circuit board, and wherein said insulator means is a first insulator means when said plurality of terminal contacts are female terminal contacts and wherein said insulator means is a second insulator means when said plurality of terminal contacts are male terminal contacts, respectively; and invertible common metal shell means for enclosing and securing said insulator means to the printed circuit board, said invertible common metal shell means including a first metal shell having a first cross-sectional area configured for enclosing and securing said first insulator means to the printed circuit board, and a second metal shell integral with said first metal shell having a second cross-sectional area configured for enclosing and securing said second insulator means to the printed circuit board, said second cross-sectional area being unequal to said first cross-sectional area, and wherein said invertible common metal shell means is invertible with respect to the printed circuit board to selectively position said first metal shell for enclosing and securing said first insulator means to the printed circuit board when said plurality of terminal contacts are said female terminal contacts and to selectively position said second metal shell for enclosing and securing said second insulator means to the printed circuit board when said plurality of terminal contacts are said male terminal contacts.

2. The convertible connector of claim 1 further comprising first and second mounting tabs extending from said first metal shell in opposed relation; and a mounting stud attached to each said first and second mounting tabs, and wherein said mounting studs permit said invertible common metal shell means to be selectively inverted with respect to the printed circuit board to secure said first insulator means thereto when said plurality of terminal contacts are said female terminal contacts and to secure said second insulator means to the printed circuit board when said plurality of terminal contacts are said male terminal contacts.

3. The convertible connector of claim 1 wherein said first insulator means includes shoulder means engaging said female terminal contacts received therein for press fitting said female terminal contacts into the printed circuit board and wherein said second insulator means includes shoulder means engaging said male terminal contacts received therein for press fitting said male terminal contacts into the printed circuit board.

4. The convertible connector of claim 1 wherein each of said male terminal contacts includes an end disposed within said invertible common metal shell means and further comprising a plurality of closed-ended tubular members wherein each of said plurality of closed-ended tubular members is fitted over a corresponding one of said ends of said male terminal contacts.

5. The convertible connector of claim 1 wherein said first and second cross-sectional areas are similarly shaped, and wherein said second cross-sectional area is smaller than said first cross-sectional area.

6. The convertible connector of claim 5 wherein each of said first and second cross-sectional areas is D-shaped.

* * * * *